US010393372B2

(12) United States Patent
Martin

(10) Patent No.: US 10,393,372 B2
(45) Date of Patent: Aug. 27, 2019

(54) APPARATUS FOR FIRING AND COMBUSTION OF SYNGAS

(71) Applicant: Entech—Renewable Energy Solutions Pty. Ltd., Western Australia (AU)

(72) Inventor: Neil Martin, Western Australia (AU)

(73) Assignee: ENTECH-RENEWABLE ENERGY SOLUTIONS PTY.LTD., Canning Vale, Western (AU)

( * ) Notice: Subject to any disclaimer, the term of this patent is extended or adjusted under 35 U.S.C. 154(b) by 442 days.

(21) Appl. No.: 15/038,980

(22) PCT Filed: Nov. 14, 2014

(86) PCT No.: PCT/AU2014/001045
§ 371 (c)(1),
(2) Date: May 24, 2016

(87) PCT Pub. No.: WO2015/074093
PCT Pub. Date: May 28, 2015

(65) Prior Publication Data

US 2016/0377283 A1 Dec. 29, 2016

(30) Foreign Application Priority Data

Nov. 25, 2013 (AU) ..... 2013904545

(51) Int. Cl.
*F23D 14/28* (2006.01)
*F23L 7/00* (2006.01)
(Continued)

(52) U.S. Cl.
CPC ..... *F23D 14/28* (2013.01); *C10J 3/82* (2013.01); *F23D 14/20* (2013.01); *F23D 14/32* (2013.01);
(Continued)

(58) Field of Classification Search
CPC .. F23L 7/00; F23D 14/20; F23D 14/32; F23D 14/68; F23D 14/82; F23D 14/28;
(Continued)

(56) References Cited

U.S. PATENT DOCUMENTS 5,375,995 A 12/1994 Döbbeling et al.
7,003,957 B2 2/2006 Griffin et al.
(Continued)

FOREIGN PATENT DOCUMENTS

CN 1779328 A 5/2006
EP 0610722 A1 8/1994

OTHER PUBLICATIONS

International Search Report and Written Opinion received in Patent Cooperation Treaty Application No. PCT/AU2014/001045, dated Feb. 11, 2015, 9 pages.
Office Action for Chinese Patent Application No. 201480073707.3, dated Jun. 7, 2017, and English translation thereof. (35 pages).

*Primary Examiner* — Alfred Basichas
(74) *Attorney, Agent, or Firm* — Haynes and Boone, LLP

(57) ABSTRACT

An apparatus for firing and combusting syngas is described. The apparatus comprises a vessel having a first chamber with an inlet for receiving syngas from a gasifier, an ignition chamber provided with an auxiliary burner to ignite the diluted syngas; a combustion chamber provided with an inlet for introducing a combustion agent for combusting the ignited syngas and a retention chamber for retaining the resulting combustion products for a predetermined residence period, the retention chamber being provided with an outlet for withdrawing said combustion products. The first chamber is configured to receive a diluent fluid to dilute the syngas to a predetermined composition below a lower explosive limit (LEL). Preferably the diluent fluid is an oxygen-containing gas.

21 Claims, 2 Drawing Sheets

(51) Int. Cl.

| | |
|---|---|
| ***F23D 14/20*** | (2006.01) |
| ***F23D 14/32*** | (2006.01) |
| ***F23D 14/68*** | (2006.01) |
| ***F23D 14/82*** | (2006.01) |
| ***C10J 3/82*** | (2006.01) |
| ***F23G 5/027*** | (2006.01) |
| ***F23G 5/16*** | (2006.01) |

(52) U.S. Cl.
CPC ..... *F23D 14/68* (2013.01); *F23D 14/82* (2013.01); *F23G 5/027* (2013.01); *F23G 5/16* (2013.01); *F23L 7/00* (2013.01); *C10J 2300/0916* (2013.01); *C10J 2300/0946* (2013.01); *C10J 2300/1606* (2013.01); *C10J 2300/1675* (2013.01); *F23C 2201/301* (2013.01); *F23C 2900/99011* (2013.01)

(58) Field of Classification Search
CPC ..... C10J 3/82; C10J 2300/0946; C10J 2300/0916; C10J 2300/1675; C10J 2300/1606; F23G 5/027; F23G 5/16; F23C 2201/301; F23C 2900/99011
See application file for complete search history.

(56) References Cited

U.S. PATENT DOCUMENTS

| | | | |
|---|---|---|---|
| 2006/0107667 | A1 | 5/2006 | Haynes et al. |
| 2012/0122046 | A1 | 5/2012 | Tsantrizos et al. |
| 2013/0098750 | A1 | 4/2013 | Nickerson et al. |

APPARATUS FOR FIRING AND COMBUSTION OF SYNGAS

CROSS REFERENCE TO RELATED APPLICATIONS

The present application is a U.S. National Stage patent application of International Patent Application No. PCT/AU2014/001045, filed on Nov. 14, 2014, which claims priority to Australian Application No. 2013904545 filed Nov. 25, 2013 the disclosures of which are incorporated herein by reference in their entirety.

FIELD

An apparatus for firing and combustion of syngas is disclosed. Particularly, though not exclusively, an apparatus for firing and combustion of syngas produced from pyrolysis and gasification of low-rank carbonaceous material such as biomass or solid waste is disclosed.

BACKGROUND

Increasingly, gasification is being used to convert solid waste, often referred to as waste derived fuel (WDF) into valuable forms of energy. Gasification of carbonaceous materials involves a thermal reaction between the carbonaceous material, oxygen and steam at temperatures in excess of 400° C. to generate a mixture of low weight hydrocarbons, such as methane, carbon monoxide and hydrogen known as syngas. Gasification is widely used to produce syngas for firing a boiler to generate steam, for use as a fuel in a gas engine, or for refining into chemicals, liquid fuels and hydrogen and has been identified as a key enabling technology for advanced high-efficiency, low-emission non-fossil fuel and renewable energy power generation.

The application of high temperature gasification and other medium to high combustion air input thermal processes to manage solid waste presents many difficulties, particularly because of the lack of homogeneity of the contents in terms of size and composition compared to other carbonaceous materials such as coal and biomass. The average moisture content of many types of solid waste may vary from 20-60% or higher, and the average incombustible content may vary from 5-30% or higher, with some waste charges having 100% incombustible items (e.g. glass, metals, etc.). A high incombustible content results in a high density charge with concomitant increased accumulation of incombustibles/ash content. The larger percentage of inorganic solids and ash that is not consumed by combustion processes leads to an increase in the downstream clean-up processes required to provide a syngas product stream and reduced production efficiency.

In view of the heterogeneity and composition variability of solid waste feedstock, the syngas thereby produced from gasification may also demonstrate variability in its chemical composition, calorific value, moisture content and volume. In particular, the syngas may also include pollutants whose concentrations are affected by the thermal conditions they are exposed to in downstream firing and combustion processes, such as the Destruction Rate Efficiency (DRE) of chlorinated hydrocarbons, polycyclic aromatic hydrocarbons (PAHs), dioxins, furans, other volatile organic compounds (VOCs) and principal organic pollutants (POPs), as well as the minimization of nitrogen conversion to NOx compounds.

Traditional afterburners and secondary combustion chambers are commonly used for off-gases that are mostly or fully oxidized, however their simple one-chamber design is inefficient at handling syngas, namely a volatile gas stream containing complex CnHn hydrocarbons that unless subjected to appropriate thermal conditions of high DRE will form noxious pollutants.

Further, measurement of DRE is difficult and expensive to accomplish.

There is therefore a need for technological advancement.

Any references to background art do not constitute an admission that the art forms a part of the common general knowledge of a person of ordinary skill in the art. The above references are also not intended to limit the application of the apparatus and process as disclosed herein.

SUMMARY

Generally, an apparatus for firing and combusting syngas is disclosed.

In accordance with one aspect of the present invention, there is provided an apparatus for firing and combusting syngas, the apparatus comprising a vessel having:

- a first chamber with an inlet for receiving syngas from a gasifier, the first chamber being configured to receive a diluent fluid to dilute the syngas to a predetermined composition;
- an ignition chamber provided with an auxiliary burner to ignite the diluted syngas;
- a combustion chamber provided with an inlet for introducing a combustion agent for combusting the ignited syngas; and,
- a retention chamber for retaining the resulting combustion products for a predetermined residence period, the retention chamber being provided with an outlet for withdrawing said combustion products.

In one embodiment, the vessel is configured to facilitate plug flow of the syngas and combustion products therethrough. Said chambers of the vessel are configured in fluid communication with respective adjacent chambers. In this example, the vessel may be a horizontally disposed cylindrical vessel.

The first chamber may be provided with a plenum disposed about an exterior wall thereof. The plenum is configured to deliver the diluent, said diluent comprising a pressurised gas, to the first chamber via a second inlet. The second inlet may take the form of a plurality of apertures in the exterior wall of the first chamber.

The ignition chamber may be provided with a burner quarrel to receive the auxiliary burner.

The combustion chamber may be an expanding conical chamber provided with a plenum disposed about an exterior wall thereof. The plenum is configured to deliver the combustion agent, said combustion agent comprising an oxygen-containing gas, to the combustion chamber via the inlet.

Preferably, the retention chamber is configured to retain the resulting combustion products for the predetermined residence period of at least 2 seconds, as measured at the outlet thereof. A residence period of at least 2 seconds may be necessary to maximise a high destruction rate efficiency (DRE) of organic contaminants within the syngas and/or combustion products.

The apparatus as described herein may be readily integrated with a gasifier for conversion of carbonaceous material, in particular solid waste, into syngas.

The apparatus as described herein may also be readily integrated with a heat recovery system to recover the heat of combustion of the syngas in said apparatus.

Accordingly, in another aspect there is disclosed a gasification system for gasifying carbonaceous material, in particular solid waste, comprising:

a gasifier for converting carbonaceous material into syngas and an apparatus for firing and combusting syngas as defined above, said apparatus being in fluid communication with the gasifier for receiving the syngas from said gasifier;

Said system may further comprise a heat recovery system for recovering thermal energy from said apparatus.

The apparatus and system described herein may be employed in a method to fire and combust syngas.

The method to fire and combust syngas comprises the steps of:

providing syngas from a gasifier;

diluting the syngas with a diluent fluid to produce a diluted syngas having a composition below the lower explosive limit (LEL)

igniting the diluted syngas with an ignition flame from an auxiliary burner mixing the ignited diluted syngas with a combustion agent in an amount of from 100% to 150% excess of stoichiometric amount of oxygen required for complete syngas combustion combusting the resulting gas mixture from the preceding step to produce combustion products, and retaining the combustion products in a retention chamber for a predetermined residence period of at least 2 seconds.

In one embodiment, the diluent fluid may comprise one or more gases from a group comprising flue gas, recycled flue gas; inert gases including nitrogen ($N_2$), argon (Ar); oxygen-containing gases including air, oxygen ($O_2$) or mixtures thereof. In one preferred form of the invention the diluent fluid is an oxygen-containing gas.

DESCRIPTION OF THE FIGURES

Notwithstanding any other forms which may fall within the scope of the apparatus as set forth in the Summary, specific embodiments will now be described, by way of example only, with reference to the accompanying drawings in which.

DETAILED DESCRIPTION OF SPECIFIC EMBODIMENTS

Figure 1:
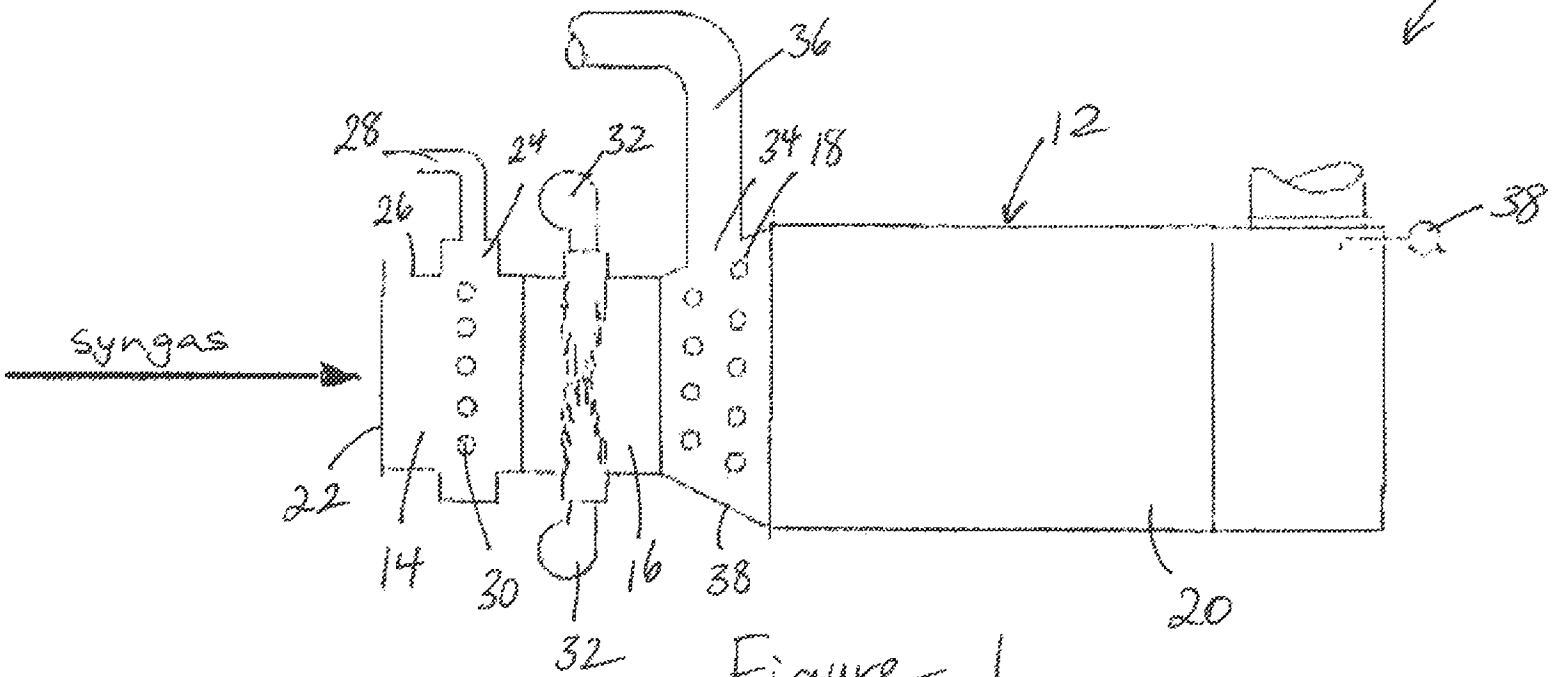
FIG. 1 is a longitudinal cross-sectional schematic representation of an apparatus for firing and combusting syngas in accordance with the disclosure.

Embodiments of the present invention relate to an apparatus 10 for firing and combusting syngas with reference to FIG. 1.

The term 'syngas' is used broadly throughout this specification to refer to a gas mixture comprising hydrocarbons, hydrogen, carbon monoxide, carbon dioxide and optionally steam produced from gasification of a carbonaceous material. Illustrative examples of suitable carbonaceous material include, but are not limited to, coal such as anthracite, bituminous coal, sub-bituminous coal, brown coal, lignite and peat, biomass, waste rubber including but not limited to vehicle tyres, waste plastic materials, solid waste, agricultural waste, industrial waste, commercial waste, institutional waste, mixtures thereof and mixtures of said carbonaceous materials with other substances.

The apparatus of the embodiment of the invention described with reference to FIG. 1 is particularly suitable for use with syngas produced from gasification of biomass or solid waste.

The term 'gasification' refers to the thermochemical decomposition of a carbonaceous material, at elevated temperatures (from about 500° C. to about 1100° C.) in an atmosphere with little or no oxygen, into light hydrocarbons, hydrogen, carbon monoxide and carbon dioxide. An ash byproduct is also produced. Depending on the nature of the carbonaceous material, the resulting ash may be used as a soil additive, a fertilizer, or as a component in construction materials.

Syngas may be fired and combusted with an oxygen-containing gas in the apparatus 10 of the present invention to produce heat and a 'syngas offgas' or flue gas. The product heat may be employed in any one of several applications where thermal energy is required, e.g. to generate steam in a steam generator and thereby drive a steam turbine to produce electricity, in a combined heat power (CHP) plant, thermal desalination, absorption chillers, process heating requirements, and so forth as will be apparent to those skilled in the art. Similarly, the thermal energy of the flue gas itself may be recovered (e.g. in a heat exchanger) and employed where thermal energy is required.

The syngas generated from gasification of solid waste may have variable chemical composition, calorific value, moisture content and volume. Additionally, the syngas may include pollutants such as chlorinated hydrocarbons, polycyclic aromatic hydrocarbons (PAHs), dioxins, furans, other volatile organic compounds (VOCs) and principal organic pollutants (POPs). These pollutants will remain in the flue gas produced from combustion of the syngas, unless they are destroyed during the combustion process. In particular, these pollutants or their precursors are affected by the thermal conditions they are exposed to in downstream firing and combustion processes.

Accordingly, the apparatus 10 of the present invention is employed to fire and combust syngas to produce heat and a flue gas, and to maximise the Destruction Rate Efficiency (DRE) of chlorinated hydrocarbons, polycyclic aromatic hydrocarbons (PAHs), dioxins, furans, other volatile organic compounds (VOCs) and principal organic pollutants (POPs), as well as the minimization of nitrogen conversion to NOx compounds.

The apparatus 10 for firing and combusting syngas includes a vessel 12 having a first chamber 14 configured to receive syngas from a gasifier 100, an ignition chamber 16, a combustion chamber 18 and a retention chamber 20 defined therein. Any one of the chambers 14, 16, 18, 20 is configured in fluid communication with respective adjacent chambers 14, 16, 18, 20.

In general, the vessel 12 is a horizontally disposed cylindrical vessel. Preferably, the diameter to length ratio of said cylindrical vessel may be selected to minimize formation of flow recirculation eddies therewithin. It will be appreciated that the vessel 12 is configured to facilitate plug flow of fluids therein.

In one example, said chambers 14, 15, 18, 20 of the vessel 12 are cylindrical in cross section and may be fabricated from mild steel plate having a thickness of 8 mm to 12 mm, which may be suitable flanged for connection therebetween. An interior of said vessel 12 may be lined with a high temperature (preferably castable) refractory material having a thickness of between 100 mm to 150 mm, suitable for withstanding operating temperatures of about 1550° C. The refractory material is secured to the steel shell of the vessel 12 by means of fasteners in the form of stainless steel anchors. The vessel 12 may also be provided with an insulation layer of between 75 mm to 100 mm thickness disposed between the refractory material and the steel shell of the vessel 12.

The first chamber 14 is provided with an inlet 22 to receive syngas from the gasifier 100. The first chamber 14 is also provided with a plenum 24 disposed about an exterior wall 26 thereof. The plenum 24 is configured to deliver a diluent fluid into the first chamber 14 via a second inlet 28. In this particular example, the second inlet 28 may take the form of a plurality of apertures 30 spaced at regular intervals in the exterior wall 26 of the first chamber 14.

In this particular embodiment, the inlet 22 comprises a single large orifice or duct. It will be appreciated that syngas produced in an upstream gasification of heterogeneous solid waste is acidic, contains tars, other organic residues and pyrolysis products, and entrained particulates. A single large orifice or duct is preferred because the inlet 22 is less likely to become blocked by particulate material or residue build up.

The diluent fluid is preferably a pressurised gas. Examples of suitable diluent fluids include, but are not limited to, flue gas, including recycled flue gas, inert gases such as nitrogen ($N_2$) or argon (Ar), oxygen-containing gases including air, oxygen ($O_2$), or mixtures thereof. Preferably, the diluent fluid is an oxygen-containing gas. Advantageously, when the diluent fluid is an oxygen-containing gas, in particular a high-oxygen content oxygen-containing gas, the volume of diluent gas required to dilute syngas to a predetermined composition is substantially lower than when the diluent fluid is flue gas or an inert gas. Generally, a high oxygen content will be understood to be 23 wt %-100 wt %. Consequently, the size of the vessel 12 and subsequent downstream equipment (not shown) can have a smaller volume capacity with enhanced production and energy efficiency.

In general, the predetermined composition of the diluted syngas comprises a gas composition below the lower explosive limit (LEL). The lowest explosive limit refers to the lowest concentration (percentage) of a gas in air capable of producing a flash of fire in presence of an ignition source. At a concentration in air lower than the LEL, gas mixtures are "too lean" to explode upon downstream ignition. Preferably the LEL is in a range between about 0.10 and about 0.12.

The ignition chamber 16 is provided with a burner quarrel to receive the auxiliary burner 32. The auxiliary burner 32 is configured to provide an ignition flame to ignite the diluted syngas in the ignition chamber 16. The ignition flame may be provided by combustion of a fossil fuel such as natural gas, fuel oil, propane and so forth as will be apparent to those skilled in the art.

In one embodiment, the combustion chamber 18 comprises an expanding conical chamber provided with an inlet 34 to receive a combustion agent. The combustion chamber 18 is also provided with a plenum 36 disposed about an exterior wall 38 thereof. The plenum 36 is configured to deliver a combustion agent to the combustion chamber 18 via the inlet. 34.

The expanding conical chamber facilitates mixing of the ignited diluted syngas with the combustion agent and accommodates an increased gas volume of the gas mixture comprising said syngas and the combustion agent. This particular configuration leads to high efficiency combustion of the resulting gas mixture in the combustion chamber 18.

The combustion agent comprises an oxygen-containing gas in the form of air, pure oxygen ($O_2$), or a high oxygen content gas mixture. Preferably, the combustion agent is provided in excess of the stoichiometric amount of oxygen required for syngas combustion. Even more preferably, the combustion agent is provided in a range of about 100% to about 150% excess of the stoichiometric amount of oxygen required for complete syngas combustion. Excess oxygen quenches the off-gas to temperatures of around 1000° C., to within the working range of most high quality refractory linings.

The retention chamber 20 is provided with an outlet 38 for withdrawing the combustion products generated in the combustion chamber 18. Preferably, the retention chamber 20 is configured to retain the resulting combustion products for the predetermined residence period of at least 2 seconds, as measured at the outlet 38 thereof. A residence period of at least 2 seconds may be necessary to maximise a high destruction rate efficiency (DRE) of organic contaminants within the syngas and/or combustion products.

In use, syngas may be introduced into the first chamber 14 of the vessel 12 via inlet 22 from a gasifier (not shown) which is configured to produce syngas from a carbonaceous material, in particular solid waste. Preferably, the gasifier is a low temperature gasifier operating at a temperature in a range of about 500° C. to about 1100° C., in particular in a temperature range of about 700° C. to about 850° C. The inventor opines that low temperature gasification has lower flow of process inputs such as air and steam, which minimises process velocity and turbulence within the first chamber 14. Consequently, the entrainment of particulate matter and heavy metals that attach to said particulate matter is minimised.

In the first chamber 14, the syngas is diluted to a gas composition below the LEL with a diluent fluid introduced into the first chamber 14 via second inlet 28. Preferably, the diluent fluid is a pressurised gas which is directed into the second inlet 28 by the plenum 24. The syngas is diluted to a gas composition below the LEL with the diluent fluid to negate deflagration or potential explosion effects.

The diluted syngas then passes into the ignition chamber 16. The diluted syngas is ignited by the ignition flame associated with the auxiliary burner 32.

The ignited syngas then passes into the combustion chamber 18 where it is mixed with a combustion agent introduced via inlet 34. The ignited syngas reacts with the combustion agent to produce a flame front, heat and combustion products. The flame front is contained within the apparatus 10 and extends from the ignition chamber 16, through the combustion chamber 18 and into the retention chamber 20.

The combustion products may contain trace organic contaminants at concentrations approaching an emissions threshold. Accordingly, the combustion products pass into the retention chamber 20 where they are retained for a predetermined residence period of at least 2 seconds, as measured at the outlet 38 of the vessel 12. During the residence period, the trace organic contaminants further decompose. The resulting combustions products (otherwise known as 'syngas offgas') is depleted of organic contaminants to concentrations below the emissions threshold.

Thermal energy (heat) produced during combustion of the syngas may be employed in any one of several applications where thermal energy is required, e.g. to generate steam in a steam generator and thereby drive a steam turbine to produce electricity, in a combined heat power (CHP) plant, thermal desalination, absorption chillers, process heating requirements, and so forth as will be apparent to those skilled in the art.

Figure 2:
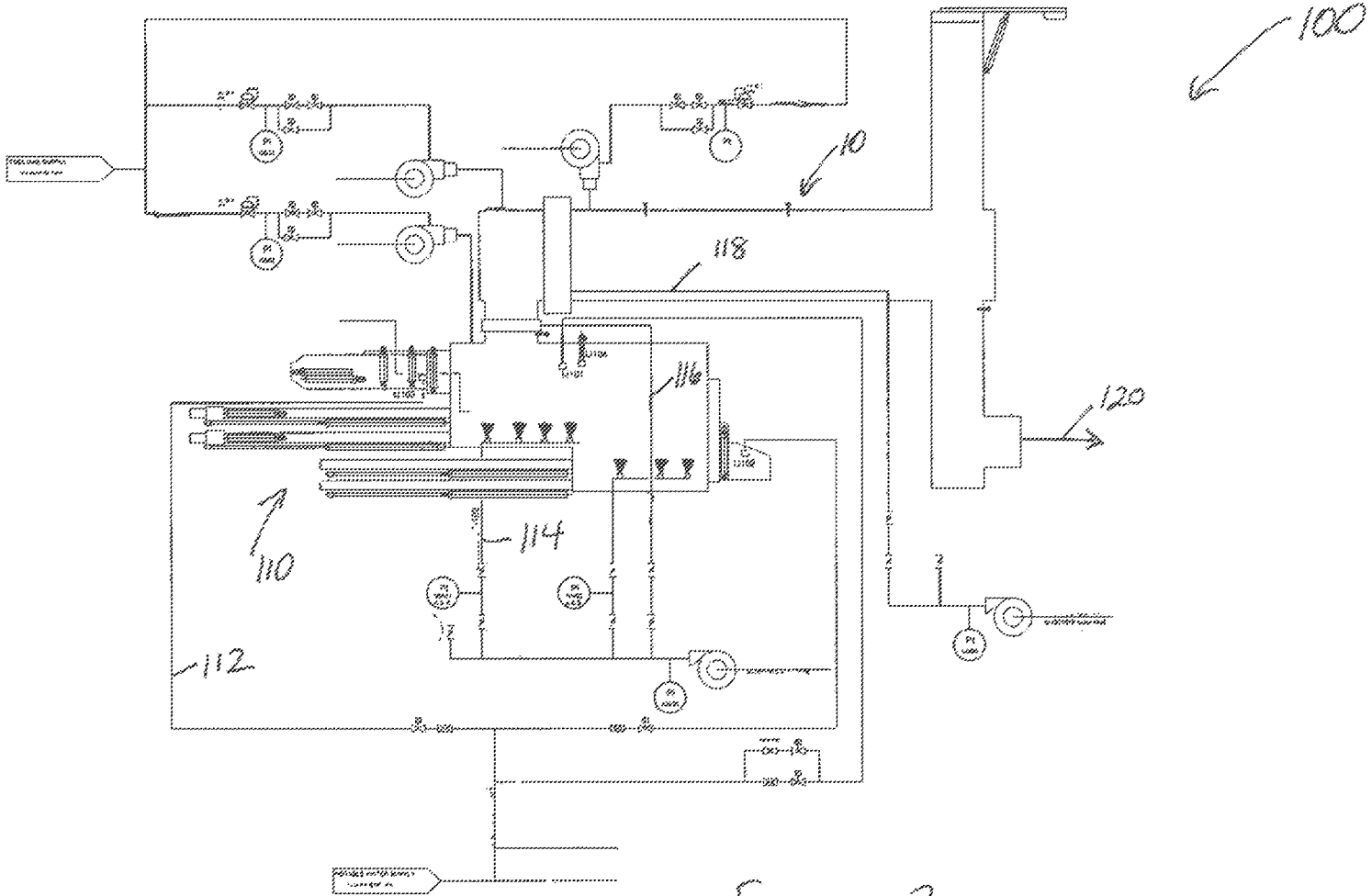
FIG. 2 is a schematic representation of a gasification system in accordance with the disclosure which integrates a gasifier with the apparatus shown in FIG. 1.

Referring to FIG. 2, there is shown one embodiment of a gasification system 100 for recovering thermal energy from carbonaceous material, in particular solid waste. The gasification system 100 includes a gasifier 110 for converting carbonaceous material such a municipal solid waste into syngas, the apparatus 10 as described previously for firing and combusting the syngas and converting it into thermal energy. The system 100 may also include a heat recovery system (not shown) for recovering thermal energy from said apparatus 10.

The gasifier 110 is disposed upstream of the apparatus 10 and configured in fluid communication with the inlet 22 via a conduit. It will be appreciated that in this arrangement, the apparatus 10 behaves as an "after-burner" for syngas produced in the gasifier 110.

The gasification system 100 may be employed as described below.

Solid waste (or an alternative carbonaceous material) is transferred from a storage hopper to a gasifier 110. Preferably, the gasifier 110 includes a plurality of furnaces adapted for low temperature gasification of waste solids. Adjacent furnaces may be disposed in stepped tiers, each furnace being provided with an agitator, such as a churning and stoking ram, to mechanically agitate the waste solids therein. It will be appreciated that alternative agitators, as will be well known to those skilled in the art, may be employed in the gasifier 110.

The gasifier 110 heats the solid waste to produce volatiles (including water vapour) and char, as described previously. Steam and air are delivered to the gasifier 110 via lines 112 and 114, respectively, and the volatiles and char undergo reforming reactions. The char reacts with oxygen-containing gas, in the form of air, to produce mainly carbon monoxide (CO) and carbon dioxide ($CO_2$) which mix with the reformed volatiles to form syngas.

The syngas is then introduced into the apparatus 10 where it is diluted with the diluent fluid 116, ignited and combusted with the combustion agent 118 to produce heat and a flue gas (or syngas offgas), as described above. The heat may be employed in various applications and the flue gas 120 can be recycled to dilute the syngas in said apparatus 10 or used as a heat transfer agent in a desired process stream.

Numerous variations and modifications will suggest themselves to persons skilled in the relevant art, in addition to those already described, without departing from the basic inventive concepts. All such variations and modifications are to be considered within the scope of the present invention, the nature of which is to be determined from the foregoing description. For example, it is to be understood that embodiments of this invention are capable of being practiced and carried out in various ways at both small (a few megawatts or less) and large (a few hundred megawatts) scales.

It will be also understood that while the foregoing description refers to specific sequences of process steps, pieces of apparatus and equipment and their configuration are provided for illustrative purposes only and are not intended to limit the scope of the present invention in any way.

In the description of the invention, except where the context requires otherwise due to express language or necessary implication, the words "comprise" or variations such as "comprises" or "comprising" are used in an inclusive sense, i.e. to specify the presence of the stated features, but not to preclude the presence or addition of further features in various embodiments of the invention.

The invention claimed is:

1. An apparatus for firing and combusting syngas, the apparatus comprising a vessel having:

a first chamber with an inlet for receiving syngas from a gasifier, the first chamber being configured to receive a diluent fluid to dilute the syngas to a predetermined composition;

an ignition chamber provided with an auxiliary burner to ignite the diluted syngas;

a combustion chamber provided with an inlet for introducing a combustion agent for combusting the ignited syngas; and a retention chamber for retaining the resulting combustion products for a predetermined residence period, the retention chamber being provided with an outlet for withdrawing said combustion products.

2. The apparatus according to claim 1, wherein the vessel is configured to facilitate plug flow of the syngas and combustion products therethrough.

3. The apparatus according to claim 1, wherein said chambers of the vessel are configured in fluid communication with respective adjacent chambers.

4. The apparatus according to claim 1, wherein the vessel is a horizontally or vertically disposed cylindrical vessel.

5. The apparatus according to claim 4, wherein, the diameter to length ratio of said cylindrical vessel is selected to minimise formation of flow recirculation eddies therewithin.

6. The apparatus according to claim 1, wherein the first chamber is provided with a plenum disposed about an exterior wall thereof.

7. The apparatus according to claim 6, wherein the plenum is configured to deliver the diluent to the first chamber via a second inlet.

8. The apparatus according to claim 7, wherein the second inlet comprises a plurality of apertures in the exterior wall of the first chamber.

9. The apparatus according to claim 1, wherein the diluent comprises a pressurised gas.

10. The apparatus according to claim 1, wherein the diluent comprises an oxygen-containing gas.

11. The apparatus according to claim 1, wherein the ignition chamber is provided with a burner quarrel to receive the auxiliary burner.

12. The apparatus according to claim 1, wherein the combustion chamber is an expanding conical chamber.

13. The apparatus according to claim 1, wherein the combustion chamber is provided with a plenum disposed about an exterior wall thereof.

14. The apparatus according to claim 13, wherein the plenum is configured to deliver the combustion agent to the combustion chamber via the inlet.

15. The apparatus according to claim 14, wherein the combustion agent comprises an oxygen-containing gas.

16. The apparatus according to claim 1, wherein the retention chamber is configured to retain the resulting combustion products for the predetermined residence period of at least 2 seconds, as measured at the outlet thereof.

17. A gasification system for gasifying carbonaceous material, in particular solid waste, comprising:

a gasifier for converting carbonaceous material into syngas; and an apparatus for combusting and firing syngas, the apparatus comprising a vessel having:

a first chamber with an inlet for receiving syngas from a gasifier, the first chamber being configured to receive a diluent fluid to dilute the syngas to a predetermined composition;

an ignition chamber provided with an auxiliary burner to ignite the diluted syngas;

a combustion chamber provided with an inlet for introducing a combustion agent for combusting the ignited syngas; and a retention chamber for retaining the resulting combustion products for a predetermined residence period, the retention chamber being provided with an outlet for withdrawing said combustion products;

said apparatus being in fluid communication with the gasifier for receiving the syngas from said gasifier.

18. The gasification system according to claim 17 further comprising a heat recovery system for recovering thermal energy from said apparatus.

19. A method to fire and combust syngas comprising the steps of:

providing syngas from a gasifier;

diluting the syngas with a diluent fluid to produce a diluted syngas having a composition below the lower explosive limit (LEL);

igniting the diluted syngas with an ignition flame from an auxiliary burner mixing the ignited diluted syngas with a combustion agent in an amount of from 100% to 150% excess of stoichiometric amount of oxygen required for complete syngas combustion;

combusting the resulting gas mixture from the preceding step to produce combustion products, and retaining the combustion products in a retention chamber for a predetermined residence period of at least 2 seconds.

20. The method according to claim 19, wherein the diluent fluid may comprise one or more gases from a group comprising flue gas, recycled flue gas; inert gases including nitrogen ($N_2$), argon (Ar); oxygen-containing gases including air, oxygen ($O_2$) or mixtures thereof.

21. The method according to claim 20, wherein the diluent fluid is an oxygen-containing gas.

* * * * *